United States Patent [19]

Nakanori et al.

[11] Patent Number: 4,702,300

[45] Date of Patent: Oct. 27, 1987

[54] DOUBLE DRUM TYPE CONTINUOUS CASTING MACHINE

[75] Inventors: Takayuki Nakanori, Shinnanyou; Tomoaki Kimura; Tadashi Nishino, both of Hitachi, all of Japan

[73] Assignees: Hitachi, Ltd.; Nisshin Steel Co., Ltd., both of Tokyo, Japan

[21] Appl. No.: 838,622

[22] Filed: Mar. 11, 1986

[30] Foreign Application Priority Data

Mar. 15, 1985 [JP] Japan ..... 60-51981

[51] Int. Cl.[4] ..... B22D 11/06; B22D 11/16

[52] U.S. Cl. ..... 164/154; 164/428

[58] Field of Search ..... 164/154, 150, 151, 451, 164/452, 428

[56] References Cited

U.S. PATENT DOCUMENTS 4,380,262 4/1983 Adler et al. ..... 164/423

FOREIGN PATENT DOCUMENTS 0081175 6/1983 European Pat. Off. .
58-23543 2/1983 Japan ..... 164/452
58-205655 11/1983 Japan .
58-221646 12/1983 Japan ..... 164/451
59-193740 11/1984 Japan ..... 164/154
59-193741 11/1984 Japan ..... 164/154

OTHER PUBLICATIONS

Abstract of Japanese Patent Publication 59-33059 Published Feb. 22, 1984.

*Primary Examiner*—Nicholas P. Godici
*Assistant Examiner*—J. Reed Batten, Jr.
*Attorney, Agent, or Firm*—Antonelli, Terry & Wands

[57] ABSTRACT

A pair of rotating rolls cool the molten metal to form a solidified shell on the surface thereof and compress the solidified shells to produce a metal sheet. A number of bearing boxes are disposed in a housing for rotatably supporting the respective ends of the rolls, and a rigid member is disposed between the bearing boxes in the housing. A prestress or initial force is applied to the rigid member through the bearing box, and a controller regulates the rotating speed of a drive in order to control the separating force occurring at a compression of the solidified shells by the rolls. By controlling the separating force, a leakage of the molten metal is prevented and a sheet metal having a uniform thickness is continuously obtained.

24 Claims, 5 Drawing Figures

ΔP : CHANGE OF THE SEPARATING FORCE P

δa : CHANGE OF THE NARROWEST GAP WITHOUT THE INITIAL FORCE F

δb : CHANGE OF THE NARROWEST GAP UNDER ACTION OF THE INITIAL FORCE F

F : INITIAL FORCE ADDED TO THE RIGID MEMBER

DOUBLE DRUM TYPE CONTINUOUS CASTING MACHINE

BACKGROUND OF THE INVENTION

The present invention relates to continuous casting with twin rolls for manufacturing a thin band metal from a molten metal and, more particularly, to a manufacturing method and apparatus of a continuous casting machine which is suitable for manufacturing a thin sheet metal of excellent quality.

In, for example, Japanese Laid Open Patent Application No. 205655/1983, a continuous casting machine with twin rolls is proposed, wherein a molten metal is poured between the rotating twin rolls and cooled by the twin rolls so as to be formed into a solidified shell on the surface of each roll and compressed to a desired thickness at the narrowest gap or nip portion between the twin rolls. A pair of hydraulic pressure cylinders provide a compressive load which acts upon the twin rolls, and a difference between the compressive load on the drive side and an operation side of the twin rolls is compensated so as to enable a regulation of a hydraulic pressure in the hydraulic pressure cylinders in accordance with a difference of a roll gap between the drive side and operation side of the rolls. While this proposed arrangement is capable of providing a quality solid condition which is equal along the width direction of the sheet metal, a disadvantage resides in the fact that it is difficult and ineffective to prevent a leakage of the molten metal through a gap between the roll and a fixed plate, since a large separating force occurs when the solidified shells formed on the rolls are pressed by the twin rolls. Moreover, a change or alteration of the gap is caused between the rolls by virtue of an action of the separating force so that a gap between the rolls and fixed plate occurs. Thus, a continuous casting operation cannot be continued for a considerable length of time by virtue of the leaking of the molten metal through the gap between the rolls and the fixed plate.

The aim underlying the present invention essentially resides in providing a continuous casting machine with twin rolls wherein an arrangement is provided for enabling a prevention of a leaking of the molten metal between the rolls and fixed plates and achieving a continuous casting work so as to provide a high grade or high quality sheet metal.

In accordance with advantageous features of the present invention, a change or alteration of the gap between both rolls caused by the separating force is minimized during the pressing of the solidified shells in order to ensure the sealing between the rolls and the fixed plates.

It is also possible in accordance with further features of the present invention to enable a thickness of the sheet metal to be equal along the width direction thereof thereby ensuring the production of high quality sheet metal.

According to the present invention, a continuous casting machine is provided with twin rolls, with the casting machine including a housing, a container having a nozzle pouring molten metal, a pair of rotating rolls cooling the molten metal poured from the nozzle in order to form a solidified shell and compressing the solidified shell so as to enable a continuous manufacturing of a sheet metal of a desired thickness. A drive means is provided for rotating the rolls, with a plurality of bearing boxes being disposed in the housing for rotatably supporting the respective ends of each of the rolls. A pair of rigid members are disposed between the bearing boxes supporting the rolls for fixing the gap of the narrowest gap portion between the twin rolls and means are provided for providing an initial force or prestress in advance to the rigid members through the bearing boxes.

By virtue of the features of the present invention, it is possible to increase the rigidity of the casting machine with regard to the separating force for reducing the gap change between both rolls by the separating force and to prevent any leakage of molten metal between the rolls and the fixed plates so that it is possible to achieve a continuous casting operation for producing high quality sheet metal.

DETAILED DESCRIPTION

Figure 1:
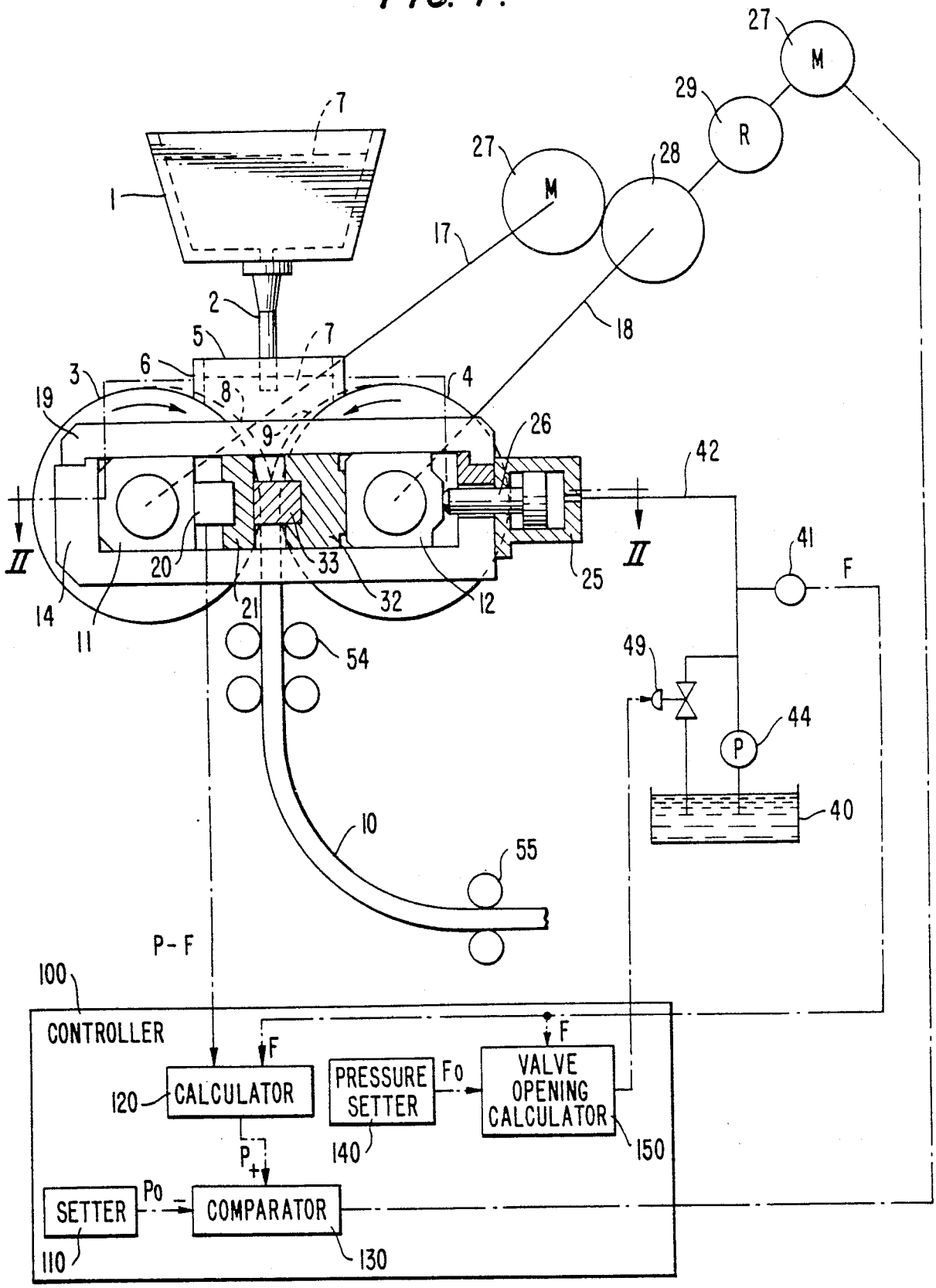
FIG. 1 is a schematic view of a continuous casting machine having twin rolls constructed in accordance with the present invention.
Figure 2:
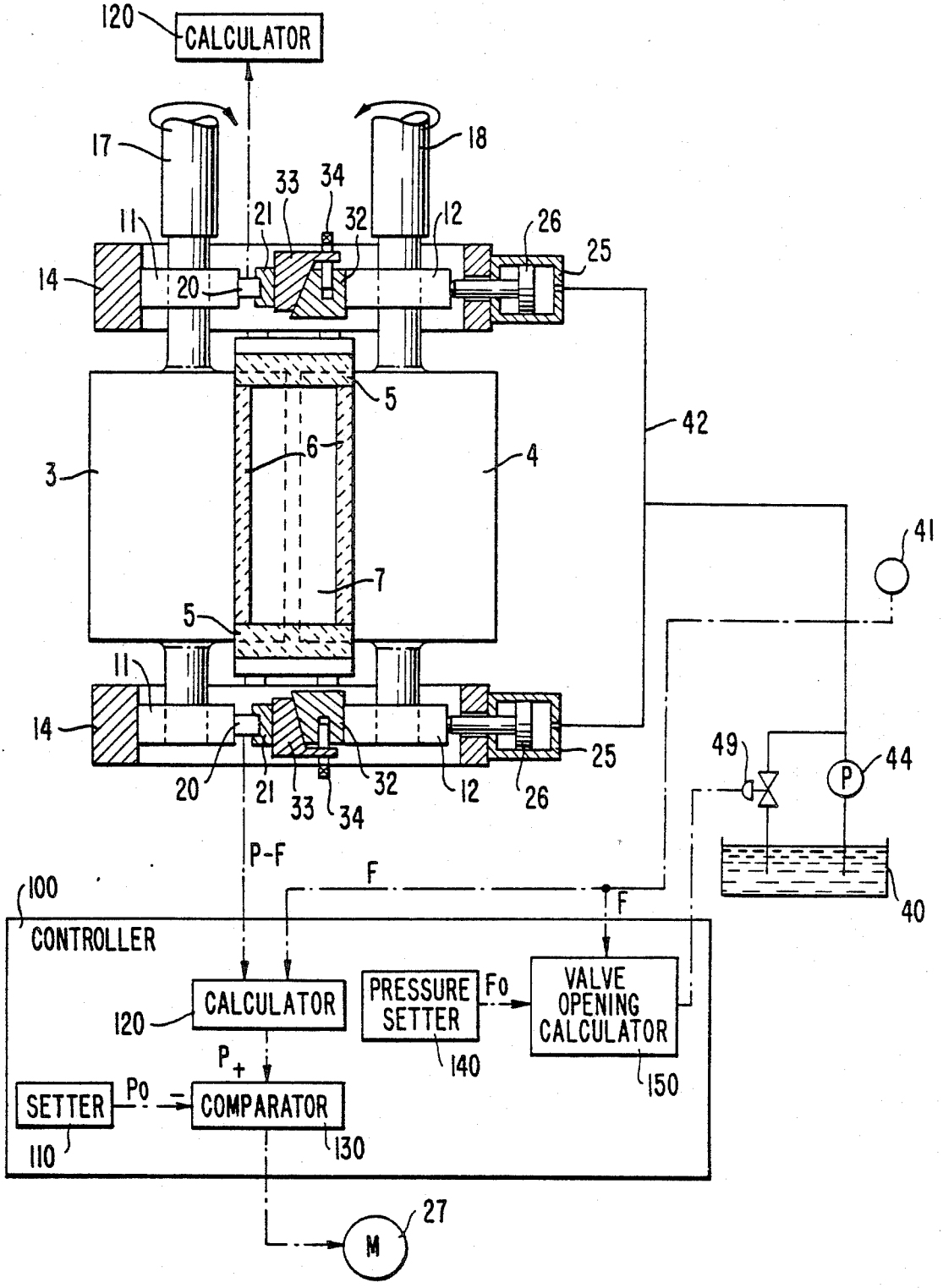
FIG. 2 is a partial cross sectional view of the continuous casting machine taken along the line II—II in FIG. 1.

Referring now to the drawings wherein like reference numerals are used throughout the various views to designate like parts and, more particularly, to FIGS. 1 and 2, according to these figures, a continuous casting machine includes a container 1 accommodating a molten metal 7 such as, for example, molten steel, with the container 1 including a nozzle 2 at a lower portion thereof for enabling a pouring of the molten metal therethrough. A pair of rolls 3, 4, made of metal, are provided for cooling the molten metal 7 poured through the nozzle 2 in order to make a solidified shell on a surface thereof and for compressing the solidified shell so as to produce a metal sheet. A pool of molten metal 7, poured from the container 1 through the nozzle 2, is surrounded by the pair of rolls 3, 4 and a rectangular container including a pair of short side members 5 and a pair of long side members 6 facing the rolls 3, 4 which are made of a refractory material having a small thermal conductivity such as, for example, a ceramic material. In order to prevent an increase in temperature of the rolls 3, 4, the rolls are constructed so as to enable an internal forced cooling so as to enable a flow of cooling liquid through the respective rolls 3, 4. Bearing boxes 11, 12 are provided at respective ends of the rolls 3, 4 so as to enable a rotatable support of the rolls 3, 4, with the bearing boxes 11, 12 being disposed in a housing 14. The rolls 3, 4, are respective driven in a direction of the arrow in FIG. 1 by a driving motor 27, a reduction gear 29, and a gear distributor or transmission 28.

A thin metal sheet 10 is formed from the molten metal 7 in the pool to be cooled and solidified through a gap between the rolls 3, 4, and is adapted to be pulled out or withdrawn by pinch rolls 54, 55, and subsequently carried to a next processing station.

The twin rolls 3, 4 are disposed in the housing 14, with a narrowest gap between the rolls being provided for forming the solidified shells 8, 9 on surfaces of the rolls 3, 4 and to compress the solidified shells 8, 9 at the narrowest gap portion for producing the continuous metal sheet 10 having a predetermined thickness of, for example, 1–10 mm. A rigid member is inserted between the bearing boxes 11, 12 for fixing the narrowest gap, and a pressure cylinder 25, having a piston rod 26 therein, is disposed between the bearing box 12 and an inside wall of the housing 14 in order to add a prestress or advanced clamping force F which acts on the rigid member through the bearing boxes 11, 12.

The rigid member includes a pair of wedges 32, 33 for adjusting the narrowest gap between the rolls 3, 4 and, as shown most clearly in FIG. 2, a fastening means such as, for example, a screw 34 for enabling an adjustment or moving of a relative position between the wedges 32, 33. The wedge 33 on the moving side, is moved with respect to the stationary wedge 32 by rotating the screw 34 and, consequently, adjusts the narrowest gap between the twin rolls 3, 4. Consequently, a thickness of the sheet metal produced can eventually be altered in dependence upon the adjustment of the gap.

A load detector 20, provided with a protective casing 21, is disposed between the bearing box 11 and the moving wedge 33 for detecting a separating force P due to compressing of the solidified shells by the rolls 3, 4. A pressurized oil is supplied from an oil tank 40 to the pressure cylinder 25 through a pump 44, and a pressure control valve 49 is disposed in a hydraulic or oil line 42. The control valve 49 is operable to regulate the pressure of the hydraulic fluid as a clamping force F, which is supplied into the pressure cylinder 25. A pressure detector 41 is disposed in the line or pipe 42 for detecting a pressure F of the hydraulic fluid. A controller 100 is provided for controlling a separating force P at a constant by regulating the rotating speed of the rolls 3, 4.

The controller 100 includes a value setter 110 for enabling a setting of a value of the separating force $P_o$, a calculator 120 for calculating an actual separating force P based on the outputs of the load indicator 20 which detect a force differential, i.e., F−P, and the pressure detected by the pressure detector 41 which detects the actual value of the pressure F, that is, the clamping force, as well as a comparator 130 for calculating and providing an operational signal to the motor 27 in accordance with a deviation of outputs $P_0$ and P between the setter 110 and the separating force calculator 120. The controller 100 is provided with an oil pressure setter 140 for setting an oil pressure value $F_o$, and a valve opening calculator 150 for controlling the pressure control valve 49 in dependence upon outputs of the pressure detector 41 so as to enable a detection of actual oil pressure F and the oil pressure setter 140.

In FIGS. 1, 2 the pair of rotating rolls 3, 4 are supported by the bearing boxes 11, 12 which respectively support the roll shafts 17, 18 of the rolls 3, 4. The rigid member, formed of an alloy having a high rigidity, is interposed between the two bearing boxes 11, 12 inside of the housing 14.

The pressure cylinder 25, having the piston therein, is disposed between the bearing box 12 and the interior wall of the housing 14 so as to enable a contact between the piston rod of the piston 26 and the bearing box 12 whereby an initial or preset force F acts upon the bearing boxes 11, 12 and the rigid member by operation of the pressure cylinder and action of the piston 26 in advance of the casting operation.

By virtue of the above described arrangement, when the separating force P occurs at the time of compressing of the solidified shells at the narrowest gap portion C between the rolls 3, 4, the members affected by the separating force P are limited primarily to the rigid member interposed between the two bearing boxes 11, 12.

Of course the value of the initial force F caused by the pressure cylinder 25 is higher than the value of the separating force P, that is, F>P. The rigidity of the rigid member is increased to a value necessary to overcome the separating force P when the separating force P occurs at the compressing of the solidified shells 8, 9, since the predetermined initial force F, which is larger than the separating force P, is added in advance to the rigid member by the pressure cylinder 25. A change of the narrowest gap C between the rolls 3, 4 is limited to less than 0.2 mm when the separating force P occurs at the compression of the solidified shells 8, 9.

Figure 5:
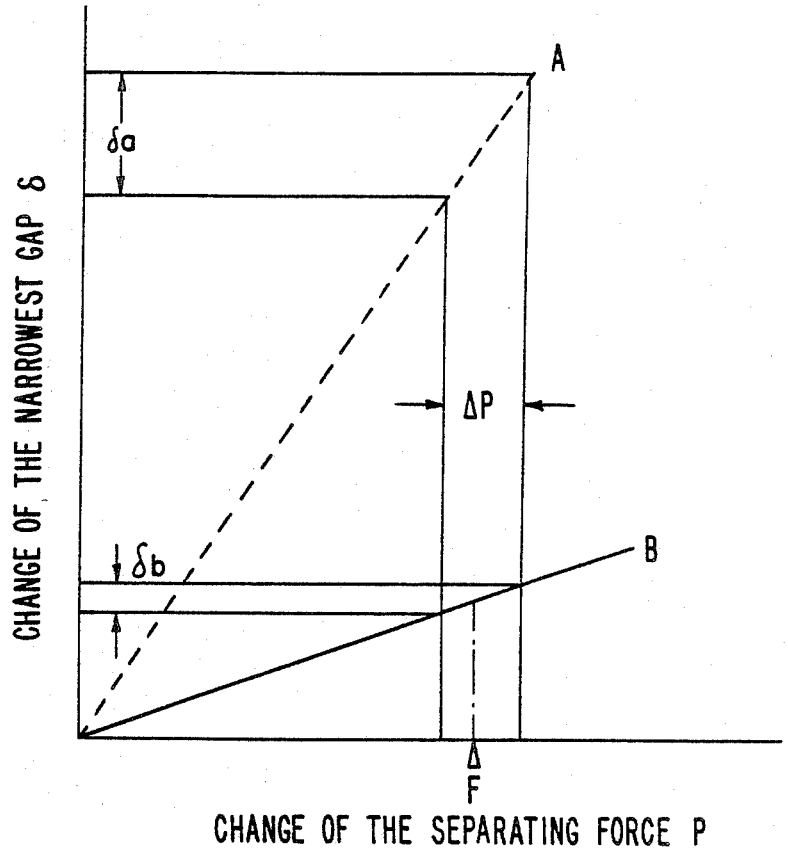
FIG. 5 is a graphical illustration of a relationship between the narrowest gap and a change of the separating force.

FIG. 5 provides a graphical illustration of the difference of the gap change $\delta$ resulting from the action of the separating force P under an action of the initial force F and with no initial force. In FIG. 5, the line A corresponds to a condition with no initial force F and the line B corresponds to a condition wherein an initial force is added on the rigid member by the pressure cylinder 25. For example, $\Delta p$ represents the separating force change during the casting operation under the action of the separating force P, with $\delta_b$ representing the change of the narrowest gap C between the rolls 3, 4 corresponding to the separating force change $\Delta p$ upon the addition of the prestress or initial force F, and $\delta_a$ represents a change of the narrowest gap C corresponding to the same separating force change $\Delta p$ with no prestress or initial force.

As readily apparent from FIG. 5, the change of the narrowest gap $\delta_b$ by virtue of the action of the separating force P is less than the gap $\delta_a$. It is possible to prevent a leakage of the molten metal through the gap, so that the continuous casting operation of a thin metal sheet having a constant thickness may be achieved by the features of the present invention.

The rigidity value K of the structure which is added to the initial force F may be determined by the following relationship:

$$(1/K)=(1/K_1)+(1/K_2) \quad (1)$$

where:

$K_1$ is a spring coefficient of the rigid member; and $K_2$ is a spring coefficient of the oil in the cylinder.

In the formula (1), a change of $K_2$ is less than 1/10 of the change of $K_1$, so that the rigidity K is basically determined in dependence upon the value of $K_1$.

Figure 3:
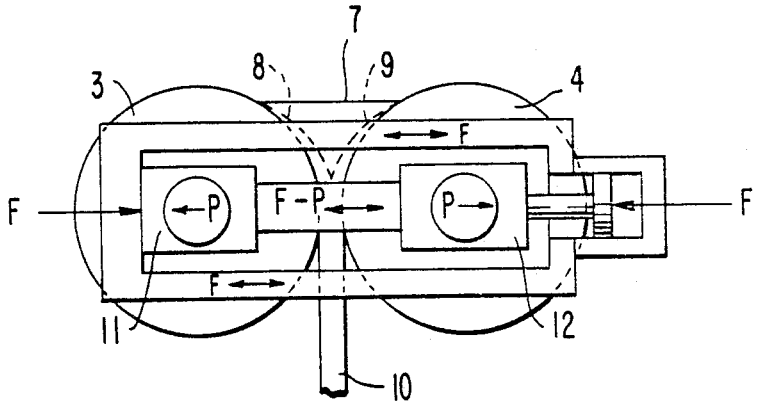
FIG. 3 is a schematic view illustrating the principle of the present invention.

FIG. 3 provides a simplified illustration of the function of the initial force F added to the rigid member. Since the separating force P acts substantially along a center line of the two bearing boxes 11, 12, the force acting between the two bearing boxes 11, 12 is F−P. The force acting at the outside or exterior portion of the bearing boxes 11, 12 is the force F generated by the pressure cylinder 25, and the force F remains constant regardless of the occurrence of the separating force P. Consequently, the portion at which the change of force occurs, due to the occurrence of the separating force P, is limited to the rigid member between the two bearing boxes 11, 12 thereby resulting in a simplified construction for the rigid member.

Figure 4:
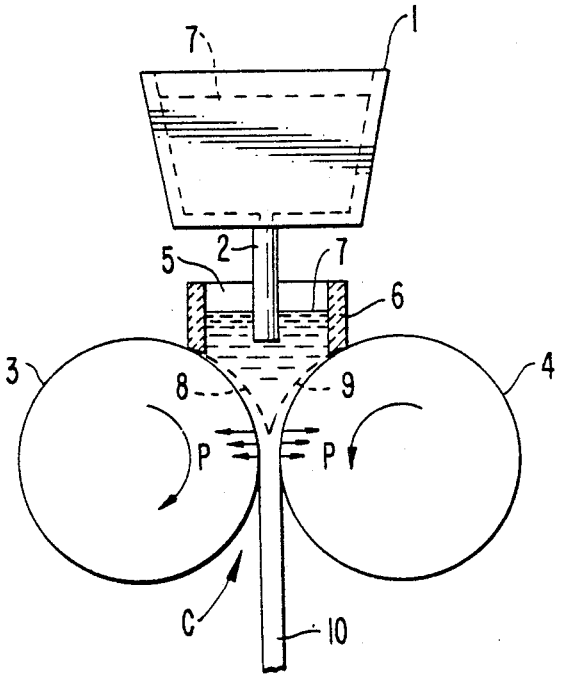
FIG. 4 is a schematic view depicting a separating force occurring at the compression of the solidified shells by the rolls of the continuous casting machine of the present invention.

While the structure of the rigid member has a small dimensional change due to compression or extension in dependence upon the occurrence of the separating force P so that the gap change between both rolls 3, 4 is considerably smaller. The housing 14 is provided with a cover member 19 at an upper portion thereof so as to enable a replacement of the rolls 3, 4 by removal of the cover member 19. The load detector 20, the protective cover 21 for the load detector, and the rigid member which includes the stationary wedge 32, moving wedge 33, and screw 34 are inserted or disposed between the bearing boxes. High pressure hydraulic fluid such as oil is supplied from the oil tank 40 to the pressure cylinder 25 by the pump 44 to the oil line 42. The pressure of the oil is controlled by regulation of the pressure control valve 49, with the pressure cylinder 25, for operating the piston 26, being mounted to an end of the housing 14, and the two bearing boxes 11, 12 being disposed inside or interiorly of the housing 14 with the initial force F in advance by the piston 26. The molten metal 7 inside of the container 1 is poured into the pool through the nozzle 2, which is formed between the surfaces of the two rolls 3, 4 and the pair of side members 5, 6. The molten metal 7 in the pool is cooled by the rolls 3, 4 and the solidified shells 8, 9 arm formed on the surface of each of the rolls 3, 4 as shown most clearly in FIG. 4. When the rolls 3, 4 are rotated in opposite directions indicated by the arrows in FIG. 4, the solidified shells 8, 9 are compressed at the narrowest gap portion C between the rolls 3, 4 and a metal sheet 10 having a predetermined thickness is produced.

The twin rolls 3, 4 are driven by the motor 27 through the reduction gear 29, the gear distributor or transmission 28, drive shafts 17, 18, respectively. The initial force F is appled to the bearing boxes 11, 12 by the piston 26 of the pressure cylinder 25. This initial force F is set to a predetermined or necessary value which is higher or greater than the separating force P occurring at the compression of the solidified shells 8, 9 by an adjustment of the pressure control valve 49 based upon the output signal of the valve opening calculator 150 in the controller 100.

Since a predetermined initial force F is provided in advance in the manner described above, even when the separating force P, due to the compression of the solidified shells 8, 9 occurs at the narrowest gap portion C between the rolls 3, 4 the influence of the separating force P is limited to the rigid member located between the bearing boxes 11, 12 and no influence is exerted upon the housing 14 or the pressure cylinder 25.

The load detector 20 is disposed between the two bearing boxes 11, 12 for enabling a detection of the actual separating force P when the solidified shells 8, 9, formed on each of the rolls 3, 4 are compressed by the rolls 3, 4, and the rotating speed of the rolls 3, 4 is controlled by the controller 100 in accordance with the change of the separating force P. That is, if the actual separating force P increases or becomes larger than a predetermined separating force $P_o$, the rotating speed of the rolls 3, 4 is increased so as to maintain a constant thickness of the metal sheet 10, and if the actual separating force P is reduced or becomes smaller than the predetermined separating force $P_o$, the rotating speed of the rolls 3, 4 is decreased in order to maintain the constant thickness of the metal sheet 10.

When the seprating force P occurs at the compressing of the solidified shells 8, 9 by the rolls 3, 4, the force acting between the bearing boxes 11, 12 is F − P, and the actual separating force P may be calculated or determined by the controller 100. When an initial force F, added by the pressure cylinder 25 is changed, a new initial force is determined by the separating force calculator 120 of the controller 100 in accordance with an ouput of the pressure detector 41 and the load detector 20.

The actual separating force P acting between the rolls 3, 4 can be calculated in the manner described above, the actual separating force P may be compared with the predetermined or set value $P_o$ of the setter 110 in the computer 130, and the actual separating force P may be constantly controlled by regulation of the rotational speed of the motor 27 in accordance with the output signals of the computer 130. That is, if the actual separating force P increases or becomes larger than the value $P_o$, the rotating speed of the rolls 3, 4 is increased by regulating the speed of the motor 27 in order to maintain the actual separating force at a constant level. If the actual separating force P becomes less than $P_o$, the rotating speed of the rolls 3, 4 is decreased and, accordingly, the thickness of the solidified shells 8, 9, formed on the surface of the rolls 3, 4 can be maintained so as to be equal to each other by a controlling of the rotating speed of the rolls 3, 4, so that the actual separating force P occurring during or at a compression of the solidified shells is maintained at a constant level.

The rigid member may be in the form of a single block member or adjustable by use of the protective cover 21, wedges 32, 33, and fastener or screw 34 as shown in FIG. 2, which provides an illustration of a gap adjusting mechanism between the rolls 3, 4. Additionally, the load detector 20, the protective cover 21, pair of wedges 32, 33 with adjusting screws 34 are disposed between the two bearing boxes 11, 12 in order to obtain a sheet of metal having a various thickness. In this connection, the pair of short side wall members 5 of the fixed plates are replaced by another pair of short side wall members corresponding to the desired thickness of the sheet metal 10. The movable wedge 33 is moved with respect to the stationary wedge 32 by rotating the adjusting screw 34 and thereby the gap between the bearing boxes 11, 12 is altered. Thus, the narrowest gap C between the rolls 3, 4 and the thickness of the metal sheet 10 can eventually be changed or adjusted.

As shown most clearly in FIG. 1, the cover beam 19 is provided on the upper portion of the housing 14, with the cover beam 19 being detachable so that a replacement of the rolls 3, 4 inside of the housing 14 is greatly facilitated. Although the load detector 20 with the protective cover 21 and the wedge mechanism 32, 33 and adjusting screw 34 are interposed between the bearing boxes 11, 12, it is possible, in accordance with the present invention, to provide for a plurality of block members rather than the wedge mechanisms.

Moreover, as can readily be appreciated, an actuator for applying the initial force F between the bearing boxes 11, 12 need not be limited to the fluid pressure cylinder of FIG. 1 but rather the same effect can also be obtained by utilizing a torque motor, a screw drive mechanism, or the like, with the wedges 32, 33, and adjusting screw 34 being operable by a motor or the like.

The separating force P which occurs between the rolls 3, 4 exerts and influences only within an area between the bearing boxes 11, 12, so that the deformation due to the separating force P is limited in the rigid member which comprises the wedge members 32, 33, and adjusting screws 34, and a leg weight structure may be utilized for the housing 14 and the force supporting mechanism. For example, an amount of deformation due to the separating force can be limited to less than 0.2 mm when a metal sheet having a thickness in the range of 2–5 mm and 1000 mm in width is produced.

Moreover, by virture of the features of the present invention, the leakage of the molten metal is completely prevented and a stable casting operation may be carried out since the deformation by the separating force is reduced to less than 0.2 mm. Since the load detector 20 is disposed between the bearing boxes 11, 12, the separating force P acting between the rolls 3, 4 can be accurately measured and calculated so that the solidified shells 8, 9 can be controlled to a predetermined thickness corresponding to a thickness of the metal sheet 10. For example, a continuous casting machine constructed in accordance with the present invention may be provided with a pair of rolls 3, 4 having a diameter of 800 mm and an axial length of a roll surface of 1200 mm so as to enable a production of a metal sheet 10 having 2–5 mm in thickness and 1000 mm in width at a production speed of 20–30 M per minute in a reliable fashion.

As evident from the above detailed description, the continuous casting machine of the present invention improves the gap change between the twin rolls due to the separating force at the compression of the solidified shell, prevents the leakage of the molten metal between the rolls and the fixed plates, and ensures a stable continuous casting operation thereby enabling a production of high quality metal sheets.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A continuous casting machine comprising:

a pair of housing means, a container means for accommodating a molten metal, a nozzle means provided on said container means for enabling a pouring of the molten metal, a pair of rotatable roll means for cooling the molten metal poured from the nozzle means to form a solidified shell on a surface of each of said roll means and for compressing the solidified shells to produce a metal sheet, drive means for rotating the roll means, a pair of fixed plates disposed adjacent to a surface of the roll means for forming a pool of molten metal received from said nozzle means, two pair of bearing box means respectively disposed in the housing means for rotatably supporting respective end portions of each roll, a pair of rigid means disposed between adjacent bearing box means in each of said housing means for fixing a narrowest gap portion between the roll means, and means for providing an initial force to the roll means disposed adjacent to one of the bearing box means in each of the housing means to act as a clamping force on the rigid member through the associated bearing box means.

2. A continuous casting machine as claimed in claim 1, wherein the rigid means includes a means for adjusting a length of the rigid means.

3. A continuous casting machine as claimed in claim 2, wherein said rigid means comprises a stationary wedge member, a movable wedge member, and said means for adjusting includes means for moving the movable wedge member to alter a relative position between the wedge members.

4. A continuous casting machine as claimed in claim 1, wherein said means for providing the initial force comprises a pressure cylinder means having a piston disposed therein.

5. A continuous casting machine as claimed in claim 4, further comprising means for supplying a pressurized fluid to the pressure cylinder means.

6. A continuous casting machine as claimed in claim 5, wherein the fluid supplying means comprises tank means for accommodating the fluid therein, means for connecting the tank means and the pressure cylinder means, a pump means for supplying the fluid to the pressure cylinder means, and a regulation valve means for regulating a pressure of the fluid supplied by the pump means.

7. A continuous casting machine comprising: a housing means, a container means for accommodating a molten metal, a nozzle means provided on said container means for enabling a pouring of the molten metal, rotatable roll means for cooling the molten metal poured through the nozzle means to form a solidified shell on a surface of each of the roll means and for compressing the solidified shells to produce a metal sheet, drive means for rotating the roll means, a plurality of bearing box means disposed in the housing means for rotatably supporting respective end portions of each of the roll means, rigid means disposed between the bearing box means in the housing means for fixing a narrowest gap portion between the roll means, a load detector means disposed between the bearing box means for detecting a load caused by a separating force occurring at a compression of the solidified shells, means for adding an initial force disposed adjacent to one of the bearing box means in the housing means to act as a clamping force on the rigid means through the associated bearing box means and controller means for controlling a value of the separating force occurring at the compression of the solidified shells in accordance with a detected signal of the load detector means.

8. A continuous casting machine as claimed in claim 7, wherein the controller means comprises means for setting a predetermined separating force, means for calculating an actual separating force based on outputs of the load detector means, and means for calculating an operationals signal to regulate a rotational speed of the drive means in accordance with outputs of the setting means and the separating force calculating means.

9. A continuous casting machine as claimed in claim 7, wherein the controller means comprises means for regulating a rotating speed of the drive means to maintain a substantially constant separating force.

10. A continuous casting machine as claimed in claim 7, wherein the controller means comprises means for setting the value of the initial force of the initial force adding means, and means for regulating a value of the initial force of the initial force adding means in accordance with a real value of the initial force and a predetermined value set by the initial force setting means.

11. A continuous casting machine as claimed in claim 7, wherein the initial force adding means comprises a pressure cylinder means accommodating a piston means.

12. A continuous casting machine as claimed in claim 11, further comprising means for supplying a pressurized fluid to the pressure cylinder means.

13. A continuous casting machine as claimed in claim 12, wherein the fluid supplying means comprises a fluid tank means for accommodating the fluid therein, means for connecting the fluid tank means to the pressure cylinder means, pump means for supplying the fluid to the pressure cylinder means through said connecting means, and means for regulating a pressure of the fluid supplied to the pressure cylinder means.

14. A continuous casting machine as claimed in claim 13, wherein the controller means comprises means for setting a predetermined value of the fluid pressure supplied to the pressure cylinder means, a pressure detector means provided in the connecting means for detecting a real value of the fluid pressure supplied to the pressure cylinder means, and means for regulating an actual value of the fluid pressure of the pressure cylinder means in accordance with outputs of the pressure detector means and the predetermined fluid pressure setting means.

15. A continuous casting machine as claimed in claim 14, wherein the fluid pressure regulating means comprises a pressure regulating valve means.

16. A continuous casting machine as claimed in claim 7, wherein the rigid means is provided with a means for adjusting the length of the rigid means.

17. A continuous casting machine as claimed in claim 16, wherein the rigid means comprises a stationary wedge member, a movable wedge member adjacent to the stationary wedge member, and wherein said means for adjusting includes a means for moving the movable wedge member so as to change a relative position between the wedge members.

18. A continuous casting machine as claimed in claim 17, wherein the load detector means is attached to a protective means, and the load detector means and the protective means are disposed between the associated bearing box means and one of the wedge members adjacent to the bearing box means.

19. A continuous casting machine as claimed in claim 18, wherein the controller means comprises means for setting a predetermined separating force, means for calculating an actual separating force occurring at a compression of the solidified shells by the rolls in accordance with the output of the load detector means, means for calculating an operational signal for regulating a rotational speed of the drive means based on the outputs of the setting means and the separating force calculating means.

20. A continuous casting machine comprising:

a pair of housing means, a container means for accommodating a molten metal, a nozzle means provided on said container means for enabling a pouring of the molten metal, a pair of rotating roll means for cooling the molten metal poured from the nozzle means to form a solidified shell on a surface of each of the roll means and for compressing the solidified shells to produce a metal sheet, drive means for rotating the roll means, a pair of fixed plate means disposed adjacent to the surface of the roll means for forming a pool of the molten metal between the two roll means, two pair of bearing box means disposed in the respective housing means for rotatably supporting respective end portions of each of the roll means, a pair of rigid means including wedge means disposed between adjacent bearing box means in each of the housing means for fixing a narrowest gap portion between the two roll means, a load detector means disposed between the bearing box means and associated rigid means for detecting a load resulting from a separating force occurring during a compression of the solidified shells, a pressure cylinder means disposed in the respective housing means for providing an initial force to the rigid means through the bearing box means, fluid supplying means having a tank means for accommodating the fluid therein, means for connecting the fluid tank means and the pressure cylinder means, a pump means provided in the connecting means for supplying pressurized fluid to the pressure cylinder means through the connecting means, and a pressure regulating means for regulating a pressure of the fluid supplied to the pressure cylinder means, and a controller means for controlling an actual separating force occuring during the compression of the solidified shells in accordance with an output from the load detector means.

21. A continuous casting machine as claimed in claim 20, wherein the controller means includes means for regulating a rotational speed of the drive means.

22. A continuous casting machine as claimed in claim 20, wherein the controller means comprises means for setting a predetermined separating force, means for calculating an actual separating force based on the output of the load detector means, and means for calculating an operational signal for regulating a rotational speed of the drive means in accordance with outputs of the setting means and separating force calculating means.

23. A continuous casting machine as claimed in claim 22, wherein the controller means comprises means for setting a value of the initial force of the pressure cylinder means and the pressure regulating means comprises a pressure detector means provided in the connecting means for detecting an actual value of the fluid supplied to the pressure cylinder means, a regulating valve means provided in the connecting means for controlling the actual value of the fluid pressure as the initial force and means for calculating a valve opening of the regulating valve means in accordance with outputs of the pressure detector means and the initial force setting means.

24. A continuous casting machine as claimed in claim 20, wherein the wedge means comprises a stationary wedge member, a movable wedge member, and means for moving the movable wedge member so as to enable a change of the relative position between the wedge members.

* * * * *